United States Patent [19]

Sorrentino

[11] 4,325,811

[45] Apr. 20, 1982

[54] CATALYTIC CRACKING WITH REDUCED EMISSION OF NOXIOUS GAS

[75] Inventor: Ciro D. Sorrentino, Naperville, Ill.

[73] Assignee: Standard Oil Company (Indiana), Chicago, Ill.

[21] Appl. No.: 214,470

[22] Filed: Dec. 8, 1980

[51] Int. Cl.[3] ..... C10G 11/00; B01J 49/00

[52] U.S. Cl. ..... 208/113; 208/164; 252/417; 252/411 S; 423/244; 423/563; 423/566

[58] Field of Search ..... 252/417, 411 S; 208/113, 164; 423/168, 244 A, 563, 566

[56] References Cited

U.S. PATENT DOCUMENTS

| | | | |
|---|---|---|---|
| 3,653,833 | 4/1972 | Watson et al. | 208/113 |
| 3,778,501 | 12/1973 | Lang et al. | 252/411 S |
| 3,832,445 | 8/1974 | Kouwenhoven et al. | 423/244 A |
| 3,892,677 | 7/1975 | Naber et al. | 252/411 S |
| 4,001,375 | 1/1977 | Longo | 423/563 |
| 4,071,436 | 1/1978 | Blanton, Jr. et al. | 208/113 |
| 4,091,076 | 5/1978 | Vogel et al. | 423/244 A |
| 4,146,463 | 5/1979 | Radford et al. | 208/113 |
| 4,207,304 | 6/1980 | Beavon | 423/563 |
| 4,233,276 | 11/1980 | D'Souza et al. | 423/563 |
| 4,280,898 | 7/1981 | Tatterson et al. . | |

*Primary Examiner*—Delbert E. Gantz
*Assistant Examiner*—Olik Chaudhuri
*Attorney, Agent, or Firm*—Richard A. Kretchmer; William T. McClain; William H. Magidson

[57] ABSTRACT

A process for the control of sulfur oxide emissions from the regenerator of a fluid catalytic cracking unit which involves circulating solid particles through the process cycle which comprise cracking catalyst and a regenerable sulfur oxide absorbent, absorbing sulfur oxides with the particles in the regeneration zone, withdrawing a stream of particles from the regeneration zone and passing the stream to a reducing zone, contacting the particles in the reducing zone with a reducing gas to release absorbed sulfur oxides as a sulfur-containing gas, and returning the stream to the inventory of solid particles which is circulated between the reaction and regeneration zones. The reducing gas comprises at least one component selected from the group consisting of hydrogen and hydrocarbons, and the process conditions in the reducing zone can be adjusted to optimize the release of absorbed sulfur oxides.

12 Claims, 1 Drawing Figure

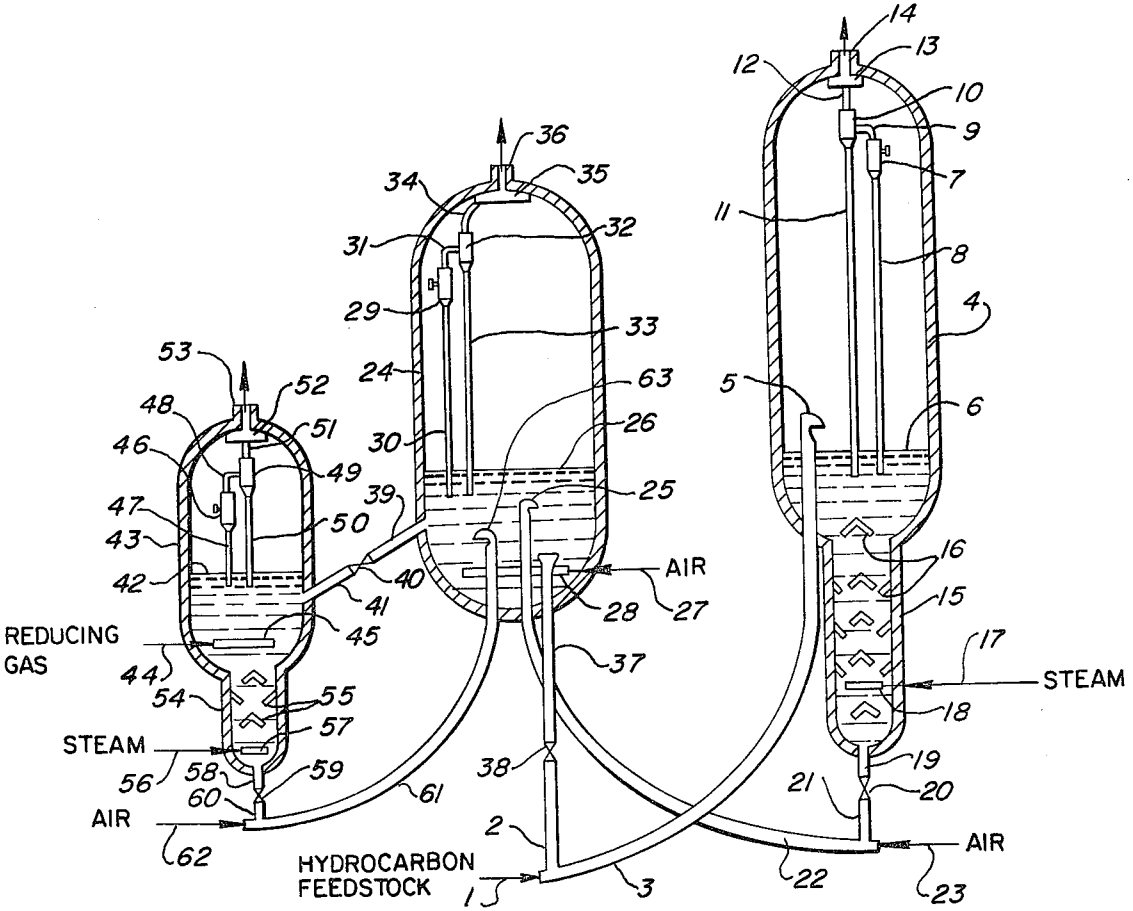
STEAM
AIR
AIR
HYDROCARBON FEEDSTOCK
REDUCING GAS
STEAM
AIR

CATALYTIC CRACKING WITH REDUCED EMISSION OF NOXIOUS GAS

BACKGROUND OF THE INVENTION

1. Field of the Invention

This invention relates to a process for reducing the emission of sulfur oxides from the regenerator of a catalytic cracking unit. More particularly, the invention relates to the use of regenerable sulfur oxide absorbents which are circulated through the catalytic cracking process in combination with the cracking catalyst.

2. Description of the Prior Art

A major industrial problem involves the development of efficient methods for reducing the concentration of air pollutants, such as sulfur oxides, in waste gas streams which result from the processing and combustion of carbonaceous fuels which contain sulfur. The discharge of these waste gas streams into the atmosphere is environmentally undesirable at the sulfur oxide concentrations which are frequently encountered in conventional operations. The regeneration of cracking catalyst which has been deactivated by coke deposits in the catalytic cracking of sulfur-containing hydrocarbon feedstocks is a typical example of a process which can result in a waste gas stream containing relatively high levels of sulfur oxides.

Catalytic cracking of heavy petroleum fractions is one of the major refining operations employed in the conversion of crude petroleum oils to useful products such as the fuels utilized by internal combustion engines. In fluidized catalytic cracking processes, high molecular weight hydrocarbon liquids and vapors are contacted with hot, finely-divided, solid catalyst particles, either in a fluidized bed reactor or in an elongated transfer line reactor, and maintained at an elevated temperature in a fluidized or dispersed state for a period of time sufficient to effect the desired degree of cracking to lower molecular weight hydrocarbons of the kind typically present in motor gasoline and distillate fuels.

In the catalytic cracking of hydrocarbons, some non-volatile carbonaceous material or coke is deposited on the catalyst particles. Coke comprises highly condensed aromatic hydrocarbons and generally contains from about 4 to about 10 percent hydrogen. When the hydrocarbon feedstock contains organic sulfur compounds, the coke also contains sulfur. As coke accumulates on the cracking catalyst, the activity of the catalyst for cracking and the selectivity of the catalyst for producing gasoline blending stocks diminishes.

Catalyst which has become substantially deactivated through the deposit of coke is continuously withdrawn from the reaction zone. The catalyst particles are then reactivated to essentially their original capabilities by burning the coke deposits from the catalyst surfaces with an oxygen-containing gas such as air in a regeneration zone. Regenerated catalyst is continuously returned to the reaction zone to repeat the cycle.

When sulfur-containing feedstocks, such as petroleum hydrocarbons containing organic sulfur compounds, are utilized in a catalytic cracking process, the coke deposited on the catalyst contains sulfur. During regeneration of the coked deactivated catalyst, the coke is burned from the catalyst surfaces which results in the conversion of the sulfur to sulfur dioxide together with small amounts of sulfur trioxide. This burning can be represented, in a simplified manner, as the oxidation of sulfur according to the following equations:

$$S\ (\text{in coke}) + O_2 \rightarrow SO_2 \quad (1)$$

$$2SO_2 + O_2 \rightarrow 2SO_3 \quad (2)$$

One approach to the removal of sulfur oxides from the waste gas produced during the regeneration of deactivated cracking catalyst involves scrubbing the gas downstream of the regenerator vessel with an inexpensive alkaline material, such as lime or limestone, which reacts chemically with the sulfur oxides to give a non-volatile product which is discarded. Unfortunately, this approach requires a large and continual supply of alkaline scrubbing material, and the resulting reaction products can create a solid waste disposal problem of substantial magnitude. In addition, this approach requires complex and expensive auxiliary equipment.

A second approach to the control of sulfur oxide emissions involves the use of sulfur oxide absorbents which can be regenerated either thermally or chemically. An example of this approach to the removal of sulfur oxides from the regeneration zone effluent gas stream in a cyclic, fluidized catalytic cracking process is set forth in U.S. Pat. No. 3,835,031 to Bertolacini et al. This patent discloses the use of a zeolite-type cracking catalyst which is modified by impregnation with one or more metal compounds of Group IIA of the Periodic Table, followed by calcination, to provide from about 0.25 to about 5.0 weight percent of Group IIA metal or metals as an oxide or oxides. The metal oxide or oxides react with sulfur oxides in the regeneration zone to form non-volatile inorganic sulfur compounds. These non-volatile inorganic sulfur compounds are then converted to the metal oxide or oxides and hydrogen sulfide upon exposure to hydrocarbons and steam in the reaction and steam stripping zones of the process unit. The resulting hydrogen sulfide is disposed of in equipment which is conventionally associated with a fluidized catalytic cracking process unit. Belgian Pat. No. 849,637 is also directed to a process wherein a Group IIA metal or metals are circulated through a cyclic fluidized catalytic cracking process with the cracking catalyst in order to reduce the sulfur oxide emissions resulting from regeneration of deactivated catalyst.

U.S. Pat. No. 4,153,534 to Vasalos discloses a process similar to that set forth in U.S. Pat. No. 3,835,031, which involves the removal of sulfur oxides from the regeneration zone flue gas of a cyclic, fluidized catalytic cracking unit through the use of a zeolite-type cracking catalyst in combination with a regenerable sulfur oxide absorbent which absorbs sulfur oxides in the regeneration zone and releases the absorbed sulfur oxides as a sulfur-containing gas in the reaction and steam stripping zones of the process unit. The sulfur oxide absorbent comprises at least one free or combined element selected from the group consisting of sodium, scandium, titanium, chromium, molybdenum, manganese, cobalt, nickel, antimony, copper, zinc, cadmium, the rare earth metals and lead.

U.S. Pat. No. 4,071,436 to Blanton et al. teaches that alumina and/or magnesia can be used to absorb sulfur oxides from a gas at a temperature in the range from 1000° to 1500° F. and the absorbed sulfur oxides can be removed by treatment with a hydrocarbon at a temperature in the range from 800° to 1300° F. It is further disclosed that sulfur oxide emissions from the regeneration zone of a cyclic, fluidized catalytic cracking unit can be reduced by combining alumina and/or magnesia with the hydrocarbon cracking catalyst. Similarly, U.S. Pat. No. 4,115,249 to Blanton et al. teaches that a cracking catalyst can be impregnated with an aluminum compound and utilized in a cyclic, fluidized catalytic cracking process for the purpose of reducing regenerator sulfur oxide emissions. Further, U.S. Pat. No. 4,166,787 to Blanton et al. discloses that a finely divided particulate alumina can be physically incorporated into the cracking catalyst for the purpose of reducing regenerator sulfur oxide emissions.

U.S. Pat. No. 4,153,535 to Vasalos et al. is directed to a process of the type set forth in U.S. Pat. No. 4,153,534, and teaches that an improved control of regeneration zone sulfur oxide emissions can be achieved by combining a sulfur oxide absorbent with a metallic promoter. The metallic promoter comprises at least one free or combined element selected from the group consisting of ruthenium, rhodium, palladium, osmium, iridium, platinum, vanadium, tungsten, uranium, zirconium, rhenium and silver. The sulfur oxide absorbent comprises at least one free or combined element which is selected from the group consisting of sodium, magnesium, calcium, strontium, barium, scandium, titanium, chromium, molybdenum, manganese, cobalt, nickel, antimony, copper, zinc, cadmium, lead and the rare earth metals. Similarly, U.S. Pat. No. 4,146,463 to Radford et al. discloses a process wherein a separately generated waste gas containing sulfur oxides and/or carbon monoxide is conveyed to the regeneration zone of a cyclic, fluidized catalytic cracking unit where these pollutants are removed by contact with a sulfur oxide absorbent and, if desired, an oxidation promoter, wherein the absorbent is a metal oxide which reacts with the sulfur oxides to form nonvolatile inorganic sulfur compounds and the promoter comprises at least one free or combined metallic element selected from Groups IB, IIB and III--VIII of the Periodic Table.

An article entitled "Bench-Scale Investigation On Removing Sulfur Dioxide from Flue Gases," by Bienstock et al. in Journal of the Air Pollution Control Association, Vol. 10, No. 2, April 1960, pp. 121–125, discloses the results of a screening program which involved the preparation and testing of a variety of common metallic oxides as sulfur dioxide absorbents. It is further disclosed that reducing gases such as producer gas, hydrogen, and carbon monoxide can be used to regenerate a spent alkalized alumina absorbent. Similarly, an article entitled "Removal of $SO_2$ from Waste Gases by Reaction with $MnO_x$ on Gamma-Alumina," by Van den Bosch (Proceedings of the 3rd International Symposium On Chemical Reaction Engineering; International Symposium On Chemical Reaction Engineering 3rd, Northwestern University, 1974; Volume I, Chemical Reaction Engineering-II, pp. 571–587) suggests the use of $MnO_x$ on gamma-alumina in a cyclic regenerative operation consisting of reaction with the sulfur dioxide in a flue gas and regeneration of the spent absorbent with hydrogen at elevated temperatures. Further, an article entitled "Reduction of Sulfates by Hydrogen," by Habashi et al. in the Canadian Journal of Chemistry, Vol. 54, 1976, pp. 3646–3650, discloses the results of an experimental evaluation of the effect of hydrogen on a plethora of metal sulfates at elevated temperature. However, none of these three references contains any mention of a catalytic cracking process, and they all fail to suggest any method for reducing the production of sulfur oxides in the regenerator of a fluid catalytic cracking unit.

SUMMARY OF THE INVENTION

This invention is directed to a process for the cyclic, fluidized catalytic cracking of a sulfur-containing hydrocarbon feedstock which comprises (i) cracking said feedstock in a reaction zone through contact with solid particles to produce lower boiling hydrocarbons and cause a deposit of sulfur-containing coke on said particles, wherein said solid particles comprise cracking catalyst and a regenerable sulfur oxide absorbent; (ii) passing coke-containing solid particles from the reaction zone to a regeneration zone; (iii) removing said sulfur-containing coke deposit from the solid particles in said regeneration zone by burning with an oxygen-containing gas, thereby forming sulfur oxides; (iv) absorbing with said absorbent at least a portion of the sulfur oxides produced by said burning of the sulfur-containing coke deposit in said regeneration zone; and (v) passing coke-depleted solid particles from the regeneration zone to the reaction zone; wherein emissions of sulfur oxides from the regeneration zone are reduced by the method which comprises: (a) continuously withdrawing a stream of coke-depleted solid particles having sulfur oxides absorbed therein from the regeneration zone and passing said stream to a reducing zone; (b) contacting said stream in the reducing zone with a reducing gas at a temperature in the range from about 590° to about 820° C., said reducing gas comprising at least one component selected from the group consisting of hydrogen and hydrocarbons, whereby absorbed sulfur oxides in said stream of particles are released as a sulfur-containing gas; and (c) after said contacting with the reducing gas in said reducing zone, passing the stream of particles back to the inventory of solid particles which is circulated between said reaction and regeneration zones.

An object of this invention is to provide an improved method for the fluidized catalytic cracking of a sulfur-containing hydrocarbon feedstock.

Another object of this invention is to provide an improved method for reducing sulfur oxide emissions from the regenerator of a fluidized catalytic cracking unit.

A further object of this invention is to provide an improved method for regenerating a regenerable sulfur oxide absorbent which is circulated with cracking catalyst through a fluidized catalytic cracking process.

A still further object of this invention is to provide an improved method for the use in a fluidized catalytic cracking process of a sulfur oxide absorbent which can release absorbed sulfur oxides as a sulfur-containing gas upon contact with a hydrocarbon in the presence of a hydrocarbon cracking catalyst.

Other objectives, aspects and advantages of the invention will be readily apparent from the following detailed description and claims.

BRIEF DESCRIPTION OF THE DRAWING

The attached drawing is a schematic representation of one embodiment of the present invention.

DETAILED DESCRIPTION OF THE INVENTION

The use of regenerable sulfur oxide absorbents in a fluidized catalytic cracking process to absorb sulfur oxides in the regeneration zone and release them upon contact with the reducing environment in the reaction zone is a known process for the control of regenerator sulfur oxide emissions. Unfortunately, in such a process the conditions in the reaction zone are usually substantially less than ideal for a complete release of the absorbed sulfur oxides. It will be appreciated, of course, that the process conditions in the reaction zone are usually adjusted to provide an optimized slate of desired lower molecular weight hydrocarbon products from the hydrocarbon feedstock. As a consequence, it is not ordinarily possible to adjust parameters such as temperature and residence time in the reaction zone to optimal values for a release of the absorbed sulfur oxides. In addition, the deposit of coke on the fluidizable solid particles which comprise cracking catalyst and sulfur oxide absorbent is believed to inhibit the release of absorbed sulfur oxides in the reaction zone. Indeed, it is believed that the formation of coke may serve to limit the release of absorbed sulfur oxides in the reaction zone and thereby limit the amount of sulfur oxides that can be absorbed in the regeneration zone. Finally, there is essentially no control over the character of the reducing environment in the reaction zone. In view of some or all of these considerations, excessive amounts of absorbent may be required to effect a satisfactory reduction of regenerator sulfur oxide emissions.

It has been discovered that when solid particles comprising cracking catalyst and a regenerable sulfur oxide absorbent are circulated through a fluidized catalytic cracking process to control regenerator sulfur oxide emissions, an improved reduction of regenerator sulfur oxide emissions can be effected by removing a stream of coke-depleted particles from the regeneration zone, contacting the stream in a reducing zone with a reducing gas to release absorbed sulfur oxides as a sulfur-containing gas, and passing the stream back to the inventory of solid particles which is circulated between the reaction and regeneration zones. Since the process conditions in the reducing zone can be independently adjusted from those employed in the reaction zone, it is possible to substantially optimize the reducing zone conditions for removal of absorbed sulfur oxides. This optimization permits a highly efficient removal of absorbed sulfur oxides and results in an improved reduction of sulfur oxide emissions from the regeneration zone.

In the practice of the present invention, the particles containing absorbed sulfur oxides which undergo processing in the reducing zone are withdrawn from the regeneration zone and are, therefore, coke-depleted. The substantial absence of coke deposits from these particles serves to substantially eliminate any inhibiting effects that such deposits may have with respect to the release of the absorbed sulfur oxides. In addition, the residence time of the particles in the reducing zone can be adjusted to control the degree of sulfur oxide release.

The amount of solid particles withdrawn from the regeneration zone and passed to the reducing zone need only be an amount which, after processing in the reducing zone and return to the inventory of solid particles in the reaction and regeneration zones, is effective to reduce the emission of sulfur oxides from the regeneration zone. The amount can, however, vary over a wide range. For example, the amount of solid particles withdrawn from the regeneration zone and passed to the reducing zone can range from about 0.01 to about 100 percent of the total amount of solid particles which is passed to the reaction zone. In a preferred embodiment of the invention, a stream of coke-depleted solid particles is passed directly from the regeneration zone to the reaction zone while a side-stream of coke-depleted particles is passed from the regeneration zone to the reducing zone. In this preferred embodiment, the amount of solid particles withdrawn as a side-stream from the regeneration zone can range from about 0.01 to about 90 percent and preferably from about 0.01 to about 50 percent of the total amount of solid particles which is passed to the reaction zone.

The temperature in the reducing zone is desirably maintained in the range from about 590° to about 820° C., and preferably in the range from about 610° to about 760° C. Indeed, the temperature in the reducing zone is conveniently maintained at or about the same temperature as that which is employed in the regeneration zone, although it will be appreciated that the reducing zone temperature can be adjusted independently from that of the regeneration zone. Since the sulfur oxide absorbent is circulated through the process cycle with the cracking catalyst, temperatures higher than about 820° C. are not usually practical in the reducing zone because of the possibility of catalyst deactivation. On the other hand, temperatures lower than about 590° C. in the reducing zone are not usually satisfactory because the release of absorbed sulfur oxides is relatively slow at these lower temperatures.

The reducing gas which is employed in the reducing zone desirably comprises at least one component selected from the group consisting of hydrogen and hydrocarbons. Suitable hydrocarbons include but are not limited to gas oils, naphthas, natural gas, and low molecular weight hydrocarbons such as methane, ethane, propane, butane and isobutane. Suitable sources of hydrogen include, but are not limited to water gas, producer gas, and refinery fuel gases which contain hydrogen such as light ends from a catalytic cracking process or a reformer tail gas. It will be appreciated, of course, that refinery fuel gases generally comprise a mixture of hydrogen with low molecular weight hydrocarbons which contain from 1 to about 4 carbon atoms. Preferably, the reducing gas comprises hydrogen, since hydrogen is not only a highly effective reducing agent but is also unable to form coke deposits which might inhibit the release of sulfur oxides in the reducing zone. If desired, the reducing gas can contain one or more substantially inert diluent gases such as nitrogen or carbon dioxide, but the presence of such an inert diluent will generally serve to reduce the rate at which the absorbed sulfur oxides are released in the reducing zone. Consequently, the use of any substantial amount of such a diluent is not usually preferred.

In the practice of this invention, absorbed sulfur oxides are released as a sulfur-containing gas in the reducing zone. Although the invention is not to be so limited, it is believed that the absorbed sulfur oxides are initially released in the reducing zone as hydrogen sulfide and/or sulfur dioxide. Depending on the precise conditions employed in the reducing zone, any sulfur dioxide so produced can be at least partially reduced to hydrogen sulfide by the reducing environment. The sulfur-containing effluent gas from the reducing zone can be processed in conventional facilities to remove hydrogen sulfide and/or sulfur dioxide. Indeed, the reducing zone effluent gas can be conveniently processed in the conventional product recovery facilities which are associated with the catalytic cracking unit. For example, the hydrogen sulfide can be removed by scrubbing in one or more amine absorption towers. The most commonly used amines for hydrogen sulfide removal are monoethanolamine and diethanolamine. The hydrogen sulfide is subsequently removed from the amine scrubbing solution and can be converted to elemental sulfur, for example, by means of the Claus process.

After the release of absorbed sulfur oxides in the reducing zone, the absorbent containing particles are returned to the inventory of solid particles which are circulated between the reaction and regeneration zones of the catalytic cracking process. The particles which are withdrawn from the reducing zone can be passed either to the reaction zone or the regeneration zone. Indeed, it will be appreciated that all of the solid particles employed in the reaction zone can be withdrawn from the reducing zone. However, a preferred embodiment of the invention involves the direct return of these particles from the reducing zone to the regeneration zone for further absorption of sulfur oxides. If, instead, the particles are passed to the reaction zone, coke will be deposited on these particles, and it is believed that the coke deposits may, at least temporarily, inhibit the efficient absorption of sulfur oxides when the particles are ultimately passed to the regeneration zone.

When solid particles are directly returned from the reducing zone to the regeneration zone, any entrained gases from the reducing zone can be removed before passage to the regeneration zone by stripping with a gas such as steam, nitrogen and carbon dioxide. Although this stripping is not necessary, it will prevent any possibility of explosion in the regeneration zone when a reducing gas such as hydrogen is used, it will prevent a possible waste of entrained hydrogen and/or hydrocarbons, and it will also minimize or prevent the return of sulfur to the regeneration zone in the form of sulfur-containing gas. These reasons for stripping the solid particles, of course, are not applicable when the particles are passed from the reducing zone to the reaction zone.

Although a large portion of the absorbed sulfur oxides can be removed from the absorbent containing particles by contacting them solely with hydrogen and/or a hydrocarbon in the reducing zone, it is frequently observed that a complete removal cannot be effected. A substantially complete release of absorbed sulfur oxides can, however, generally be achieved if the hydrogen and/or hydrocarbon is mixed with steam. Alternatively, a substantially complete release of absorbed sulfur oxides can usually be achieved by contacting the particles with either steam or oxygen after an initial contacting with hydrogen and/or a hydrocarbon. It is believed that this incomplete release of absorbed sulfur oxides is a result of the formation of metal sulfides which can react with either steam or oxygen to release their sulfur content as a sulfur-containing gas comprising hydrogen sulfide and/or sulfur dioxide.

A preferred embodiment of the invention involves the use of a reducing gas which comprises a mixture of steam with at least one component selected from the group consisting of hydrogen and hydrocarbons. The amount of steam need only be a minor amount which is effective to enhance the ability of the hydrogen and/or hydrocarbon to release absorbed sulfur oxides in the reducing zone. The amount of steam can, however, vary over a wide range, for example, from about 0.01 to about 95 volume percent of the reducing gas. Preferably, however, the amount of steam is in the range from about 1 to about 50 volume percent of the reducing gas.

Another preferred embodiment of the invention comprises contacting the absorbent containing particles with steam subsequent to an initial contacting with the reducing gas in the reducing zone. It will be appreciated, of course, that in this embodiment the reducing gas can also contain steam. A particularly convenient method for effecting this embodiment comprises passing the particles through a steam-stripping zone after withdrawal from the reducing zone. The effluent gas from the steam-stripping zone can, for example, be passed into the reducing zone or can be directly combined with the effluent gas from the reducing zone.

The drawing is illustrative of one embodiment of the invention involving a steam-stripping of the absorbent containing particles after withdrawal from the reducing zone. A hydrocarbon feedstock which contains organic sulfur compounds is passed through line 1 and is contacted with hot solid particles comprising cracking catalyst and sulfur oxide absorbent from line 2 in the inlet portion of transfer line reactor 3. The resulting mixture of solid particles and hydrocarbon vapor passes upward through transfer line reactor 3. The feedstock undergoes catalytic cracking during passage through transfer line reactor 3, and the resulting mixture of solid particles and vapor is discharged into reactor vessel 4 through downward directed discharge head 5. The upper surface 6 of the dense phase of solid particles within vessel 4 is generally maintained below discharge head 5, thereby allowing hydrocarbon vapors to disengage from the solid particles without substantial contact with the dense phase. However, if desired, the location of phase interface 6 may be varied from a position below discharge head 5 to a position above discharge head 5. In the latter case, increased catalytic conversion of the feedstock will occur as a consequence of additional cracking taking place within the dense phase of solid particles in reactor vessel 4.

Vapors and entrained solid particles passing upward through reactor vessel 4 enter primary cyclone separator 7. Most of the entrained solid particles are separated in the first stage cyclone 7 and are discharged downwardly through dip-leg 8 and into the dense phase of solid particles within reactor vessel 4. Vapors and remaining solid particles are passed through interstage cyclone line 9 to second stage cyclone separator 10 where substantially all of the remaining catalyst is separated and passed downwardly through dip-leg 11 and into the dense phase bed of solid particles within reactor vessel 4.

Effluent vapors pass from cyclone 10, through line 12, into plenum chamber 13, and are discharged through line 14. Line 14 conveys the effluent vapors to a product recovery zone, not shown, wherein the vapors are separated into product fractions by methods which are well known in the art.

Solid particles from the dense phase bed in the lower portion of reactor vessel 4, which carry sulfur-containing coke deposits, pass downwardly into stripping zone 15. Baffles 16 are situated in stripping zone 15, and steam from line 17 is discharged through steam ring 18 into the lower portion of stripping zone 15. Steam rising through the stripping zone 15 removes volatile material and entrained hydrocarbon vapors from the solid particles as they pass downwardly through stripping zone 15. The upward flowing steam also serves to fluidize the solid particles in stripping zone 15 and in the dense phase bed within reactor vessel 4.

Solid particles carrying sulfur-containing coke deposits are withdrawn from the bottom of stripping zone 15 through standpipe 19 at a rate controlled by valve 20, and discharge through line 21 into spent catalyst transfer line 22. Solid particles from line 21 are fluidized with air from line 23 and pass upwardly through transfer line 22 and into regenerator vessel 24. Transfer line 22 terminates in a downwardly directed discharge head 25, and effluent from transfer line 22 is discharged below the surface 26 of the dense phase of fluidized solid particles in the regenerator vessel 24. Solid particles within the regenerator vessel 24 are fluidized by combustion air from line 27 which is discharged through air ring 28, whereupon the sulfur-containing coke deposits on the solid particles are burned and the catalytic activity of the particles for catalytic cracking is restored. The resulting combustion gases, which include sulfur oxides, pass upwardly through the dense catalyst phase and into the dilute phase above the catalyst interface 26. Sulfur oxides are absorbed from the combustion gases by the absorbent containing solid particles as the gases pass upwardly through the regenerator vessel 24. Sulfur oxide depleted combustion gases, together with entrained solid particles, enter primary cyclone separator 29. Most of the entrained solid particles are separated in the first stage cyclone 29 and are discharged downwardly through dip-leg 30 and into the dense phase of solid particles within regenerator vessel 24. Gases and remaining solid particles are passed through interstage cyclone line 31 to second stage cyclone separator 32 where substantially all of the remaining solid particles are separated and passed downwardly through dip-leg 33 and into the dense phase of solid particles within regenerator vessel 24. Effluent gas from cyclone separator 32 passes through line 34, into plenum 35, and is discharged through line 36. Effluent gas from line 36, which has a low content of sulfur oxides, can be discharged directly to the atmosphere or, alternatively, can be passed through conventional particulate control equipment and conventional heat exchange means prior to such discharge into the atmosphere. If desired, the effluent gas can also be passed through an expander turbine prior to discharge into the atmosphere.

Coke-depleted solid particles containing absorbed sulfur oxides are withdrawn from the bottom of regenerator vessel 24 through standpipe 37 at a rate controlled by valve 38 to supply hot coke-depleted solid particles to line 2 which is described above. Absorbed sulfur oxides in the solid particles which are passed into line 2 are partially removed as a sulfur-containing gas through contact of the particles with the hydrocarbon feedstock and cracking products in transfer line reactor 3 and reactor vessel 4 and through contact with steam in reactor vessel 4 and stripping zone 15 when the solid particles are recycled through the above described hydrocarbon cracking process. The resulting sulfur-containing gas is ultimately discharged through line 14 in combination with the hydrocarbon cracking products.

A side-stream of coke-depleted solid particles containing absorbed sulfur oxides is withdrawn from regenerator vessel 24 through line 39 at a rate controlled by valve 40, passes through line 41, and is discharged below the surface 42 of the dense phase bed of fluidized solid particles in reducing vessel 43. Solid particles within the reducing vessel 43 are fluidized, in part, by a hydrogen-containing fuel gas from line 44 which is discharged through distribution ring 45. Absorbed sulfur oxides in the solid particles are removed as hydrogen sulfide and sulfur dioxide through contact of the upwardly flowing fuel gas with the particles. Gases and entrained solid particles passing upwardly through reducing vessel 43 enter primary cyclone separator 46. Most of the entrained solid particles are separated in the first stage cyclone 46 and are discharged downwardly through dip-leg 47 and into the dense phase of solid particles within reducing vessel 43. Gases and remaining solid particles are passed through interstage cyclone line 48 to second stage cyclone separator 49 where substantially all of the remaining solid particles are separated and passed downwardly through dip-leg 50 and into the dense phase bed of solid particles within reducing vessel 43. Effluent gas passes from cyclone 49, through line 51, into plenum chamber 52, and is discharged through line 53. The effluent gas from line 53 is passed into a product recovery zone, not shown, where hydrogen sulfide and sulfur dioxide are removed by methods which are well known in the art.

Solid particles from the dense phase bed in the lower portion of reducing vessel 43 pass downwardly into stripping zone 54. Baffles 55 are situated in stripping zone 54, and steam from line 56 is discharged through steam ring 57 into the lower portion of stripping zone 54. Steam rising through the stripping zone 54 removes entrained gases from the solid particles as they pass downwardly through stripping zone 54. Further, the steam serves to fluidize the solid particles in stripping zone 54 and, in combination with the fuel gas, also serves to fluidize the particles within reducing vessel 43. In addition, the upwardly flowing steam serves to enhance the removal of absorbed sulfur oxides from the solid particles as they flow downwardly through the reducing vessel 43 and the stripping zone 54.

Solid particles having a low content of absorbed sulfur oxides are withdrawn from the bottom of stripping zone 54 through standpipe 58 at a rate controlled by valve 59 and discharge through line 60 into transfer line 61. Solid particles from line 60 are fluidized with air from line 62 and pass upwardly through transfer line 61 and into regenerator vessel 24. Transfer line 61 terminates in a downwardly directed discharge head 63, and effluent from transfer line 62 is discharged below the surface 26 of the dense phase of fluidized solid particles in the regenerator vessel 24.

Conversion of a selected hydrocarbon feedstock in a fluidized catalytic cracking process is effected by contact with a cracking catalyst, preferably in one or more fluidized transfer line reactors, at conversion temperature and at a fluidizing velocity which limits the conversion time to not more than about ten seconds. Conversion temperatures are desirably in the range from about 450° to about 565° C., and preferably from about 450° to about 540° C.

In the usual case where a gas oil feedstock is employed in a conventional fluidized catalytic cracking process, the throughput ratio (TPR), or volume ratio of total feed to fresh feed, can vary from about 1.0 to about 3.0. Conversion level can vary from about 40% to about 100% where conversion is here defined as the percentage reduction of hydrocarbons boiling above 221° C. at atmospheric pressure by formation of lighter materials or coke. The weight ratio of catalyst to oil in the reactor can vary within the range from about 2 to about 25 so that the fluidized dispersion will have a density in the range from about 16 to about 320 kilograms per cubic meter. Fluidizing velocity can be in the range from about 3.0 to about 30 meters per second, and the cracking process is preferably effected in a transfer line reactor wherein the ratio of length to average diameter is at least about 25.

In a fluidized catalytic cracking process catalyst regeneration is accomplished by burning the coke deposits from the catalyst surfaces in a regeneration zone with an oxygen-containing gas such as air. Deactivated cracking catalyst typically contains from about 0.5 to about 3 weight percent coke and regenerated catalyst desirably contains less than about 0.3, preferably less than about 0.2 and most preferably less than about 0.1 weight percent of residual coke. Any conventional regeneration technique can be employed, including that which is set forth in U.S. Pat. No. 3,909,392 to Horecky et al. (this patent is hereby incorporated in its entirety by reference). The regeneration zone temperatures are ordinarily in the range from about 565° to about 815° C. and are preferably in the range from about 620° to about 735° C. When air is used as the regeneration gas, it enters the regenerator from a blower or compressor and a fluidizing velocity in the range from about 0.05 to about 8.0 meters per second, preferably from about 0.05 to about 1.5 meters per second and more preferably from about 0.15 to about 1.0 meters per second is maintained in the regenerator.

A suitable hydrocarbon feedstock for use in a fluidized catalytic cracking process in accordance with this invention can contain from about 0.05 to about 10 weight percent of sulfur in the form of organic sulfur compounds. Advantageously, the feedstock contains from about 0.1 to about 6 weight percent sulfur and more advantageously contains from about 0.2 to about 4 weight percent sulfur wherein the sulfur is present in the form of organic sulfur compounds. Suitable feedstocks include, but are not limited to, sulfur-containing petroleum fractions such as light gas oils, heavy gas oils, wide-cut gas oils, vacuum gas oils, naphthas, decanted oils, residual fractions and cycle oils derived from any of these as well as sulfur-containing hydrocarbon fractions derived from shale oils, tar sands processing, synthetic oils, coal liquefaction and the like. Any of these suitable feedstocks can be employed either singly or in any desired combination.

Conventional hydrocarbon cracking catalysts include those of the amorphous silica-alumina type having an alumina content of about 10 to about 30 weight percent. Catalysts of the silica-magnesia type are also suitable which have a magnesia content of about 20 weight percent. Preferred catalysts include those of the zeolite-type which comprise from about 0.5 to about 50 weight percent and preferably from about 1 to about 30 weight percent of a crystalline aluminosilicate component distributed throughout a porous matrix. Zeolite-type cracking catalysts are preferred because of their thermal stability and high catalytic activity.

The crystalline aluminosilicate or zeolite component of the zeolite-type cracking catalyst can be of any type or combination of types, natural or synthetic, which is known to be useful in catalyzing the cracking of hydrocarbons. Suitable zeolites include both naturally occurring and synthetic aluminosilicate materials such as faujasite, chabazite, mordenite, Zeolite X (U.S. Pat. No. 2,882,244), Zeolite Y (U.S. Pat. No. 3,130,007) and ultrastable large-pore zeolites (U.S. Pat. Nos. 3,293,192 and 3,449,070). The crystalline aluminosilicates having a faujasite-type crystal structure are particularly suitable and include natural faujasite, Zeolite X and Zeolite Y. These zeolites are usually prepared or occur naturally in the sodium form. The presence of this sodium is undesirable, however, since the sodium zeolites have a low catalytic activity and also a low stability at elevated temperatures in the presence of steam. Consequently, the sodium content of the zeolite is ordinarily reduced to the smallest possible value, generally less than about 1.0 weight percent and preferably below about 0.3 weight percent through ion exchange with hydrogen ions, hydrogen-precursors such as ammonium ion, or polyvalent metal cations including calcium, magnesium, strontium, barium and the rare earth metals such as cerium, lanthanum, neodymium and their mixtures. Suitable zeolites are also able to maintain their pore structure under the high temperature conditions of catalyst manufacture, hydrocarbon processing and catalyst regeneration. These materials have a uniform pore structure of exceedingly small size, the cross section diameter of the pores being in the range from about 4 to about 20 angstroms, preferably from about 8 to about 15 angstroms.

The matrix of the zeolite-type cracking catalyst is a porous refractory material within which the zeolite component is dispersed. Suitable matrix materials can be either synthetic or naturally occurring and include, but are not limited to, silica, alumina, magnesia, boria, bauxite, titania, natural and treated clays, kieselguhr, diatomaceous earth, kaolin and mullite. Mixtures of two or more of these materials are also suitable. Particularly suitable matrix materials comprise mixtures of silica and alumina, mixtures of silica with alumina and magnesia, and also mixtures of silica and alumina in combination with natural clays and clay-like materials. Mixtures of silica and alumina are preferred, however, and contain preferably from about 10 to about 65 weight percent of alumina mixed with from about 35 to about 90 weight percent of silica.

Regenerable sulfur oxide absorbents which are suitable for use in the practice of this invention include but are not limited to those which are disclosed by the following U.S. Patents: (1) U.S. Pat. No. 4,153,534 to Vasalos, (2) U.S. Pat. No. 4,153,535 to Vasalos et al., (3) U.S. Pat. 4,071,436 to Blanton et al., (4) U.S. Pat. No. 4,115,249 to Blanton et al., (5) U.S. Pat. No. 4,166,787 to Blanton et al., (6) U.S. Pat. No. 4,146,463 to Radford et al., and (7) U.S. Pat. No. 3,835,031 to Bertolacini et al. These seven patents are hereby incorporated in their entirety by reference. For example, a suitable absorbent desirably comprises at least one free or combined metal selected from the group consisting of aluminum, sodium, magnesium, calcium, strontium, scandium, titanium, chromium, molybdenum, manganese, cobalt, nickel, antimony, copper, zinc, cadmium, lead and the rare earth metals. More preferably the absorbent comprises at least one free or combined metal selected from the group consisting of aluminium, magnesium, zinc, calcium, manganese, and the rare earth metals. The oxide or oxides of the metallic element or elements of the absorbent are belived to be primarily responsible for the absorption of sulfur oxides in the regeneration zone. Consequently, it is advantageous to introduce the metallic element or elements of the absorbent into the catalytic cracking process cycle in the form of the oxide or oxides. It is sufficient, however, for the practice of this process that an effective amount of one or more suitable metallic elements be introduced into the process cycle. The metallic element or elements of the absorbent are activated for the absorption of sulfur oxides in the regeneration zone as a consequence of the process steps involved in the catalytic cracking process cycle. The activation is substantially unaffected by the precise manner in which such metallic element or elements may be chemically combined when initially introduced into the process cycle.

In a particularly preferred embodiment, the absorbent comprises at least one metal oxide selected from the group consisting of the oxides of aluminum, magnesium, zinc, calcium, manganese and the rare earth metals; and more preferably, the absorbent comprises at least one oxide selected from the group consisting of alumina and magnesium oxide. For example, a combination comprising cerium and alumina is highly satisfactory. Although the use of any form of alumina is contemplated for use in the practice of this invention, gamma-alumina and eta-alumina are preferred because of their usually large surface area.

The fluidizable particulate solid which comprises the absorbent will desirably have an average size in the range from about 20 to about 150 microns and preferably less than about 50 microns. When the absorbent comprises one or more metal oxides, the best results are generally obtained when the oxide or oxides have a large surface area. This surface area is desirably greater than about 10 square meters per gram, preferably greater than about 50 square meters per gram and ideally greater than 100 square meters per gram.

The absorbent can be circulated through the catalytic cracking process in any desired manner. The particles of cracking catalyst can contain the absorbent. Alternatively, the particles of cracking catalyst can be physically mixed with a separate particulate solid which comprises the absorbent. In addition, it will be appreciated that a combination of these two alternatives is also possible.

The absorbent can be incorporated into or onto a suitable support. This support should be porous and desirably has a surface area of at least about 10, preferably at least about 50, and most preferably at least about 100 square meters per gram. Large surface areas are desirable because they permit a more efficient contacting of sulfur oxides in the regeneration zone combustion gas with the supported absorbent. Suitable supports include, but are not limited to silica, natural and treated clays, kieselguhr, diatomaceous earth, kaolin and mullite. In addition, one of the metal oxides suitable for use as an absorbent, for example, gamma-alumina, can be used as a support for one or more other metals or metal oxides which are also suitable for use as an absorbent.

The absorbent can comprise a component of a cracking catalyst as, for example, in the case of a silica-magnesia or silica-alumina catalyst. Also, the absorbent can comprise at least a portion of the matrix of a zeolite-type cracking catalyst. A particularly preferred embodiment involves the use of alumina as the absorbent which is provided in the form of a zeolite-type cracking catalyst having alumina in its matrix. The alumina content of such a matrix is desirably from about 20 to about 100 weight percent, preferably from about 40 to about 100 weight percent, and more preferably from about 60 to about 100 weight percent. The use of a zeolite-type cracking catalyst having a high alumina matrix, for example in excess of about 40 weight percent, provides a highly convenient manner in which to supply at least a portion of the absorbent to the catalytic cracking process cycle.

The absorbent is employed in an amount which is effective to provide reduced emissions of sulfur oxides in the regeneration zone effluent gas stream. Preferably, a sufficient amount of the absorbent is present in the regeneration zone to effect the absorption of at least a major portion of the sulfur oxides produced by the burning of sulfur-containing coke therein. Desirably, the absorbent comprises from about 0.1 to about 70 weight percent, preferably from about 0.1 to about 50 weight percent, and more preferably from about 0.5 to about 30 weight percent of the total solids circulated through the catalytic cracking process.

As disclosed by U.S. Pat. No. 4,153,535 to Vasalos et al., an oxidation promoter can be used in combination with the absorbent to enhance the ability of the absorbent to absorb sulfur oxides in the regeneration zone. For example, a suitable oxidation promoter comprises at least one free or combined element selected from the group consisting of ruthenium, rhodium, palladium, osmium, iridium, platinum, and rhenium. Platinum is a particularly effective oxidation promoter. Like the absorbent, the oxidation promoter can be circulated through the catalytic cracking process cycle in any desired manner. For example, the promoter can be incorporated into or onto the same particulate solid which comprises the absorbent, or can be incorporated into or onto a separate particulate solid or solids. A particularly convenient method involves the use of the absorbent, for example alumina, as a support for the promoter. However, the precise manner in which the promoter is associated with the absorbent is not critical. The amount of promoter, calculated as the elemental metal or metals, is desirably from about 0.01 to about 100 ppm, and preferably from about 0.1 to about 25 ppm with respect to the total solids circulated through the catalytic cracking process.

Although the invention disclosed herein is not to be so limited, it is believed that chemical reaction occurs between the absorbent and the sulfur oxides in the regeneration zone which results in the formation of nonvolatile inorganic sulfur compounds, such as sulfates. This chemical transformation can be summarized in a simplified manner by the following equations:

$$M_xO + SO_2 \rightarrow M_xSO_3 + \tfrac{1}{2}O_2 \rightarrow M_xSO_4 \quad (3)$$

$$M_xO + SO_3 \rightarrow M_xSO_4 \quad (4)$$

where $M_xO$ is a metal oxide and x is the ratio of the oxidation state of the oxide ion to the oxidation state of a metal component M of the metallic absorbent when combined with oxygen.

The precise mechanism by which absorbed sulfur oxides are removed from the absorbent is unknown, but it is believed that hydrogen and/or a hydrocarbon in the presence of a cracking catalyst at elevated temperatures provides a reducing environment which effects a conversion of absorbed sulfur oxides to hydrogen sulfide and sulfur dioxide, while simultaneously reactivating the absorbent for further absorption of sulfur oxides. Although the invention is not to be so limited, it is believed that the removal of absorbed sulfur oxides can be summarized in a simplified manner by the following equations:

$$M_xSO_4 + 4H_2 \rightarrow M_xO + H_2S + 3H_2O \quad (5)$$

$$xM_{SO4} + 4H_2 \rightarrow M_xS + 4H_2O \rightarrow M_xO + H_2S + 3H_2O \quad (6)$$

$$M_xSO_4 + H_2 \rightarrow M_xSO_3 + H_2O \rightarrow M_xO + SO_2 + H_2O \quad (7)$$

where x is the ratio of the oxidation state of the oxide ion to the oxidation state of a metal component M of the absorbent when combined with oxygen. The removal of absorbed sulfur oxides from the absorbent is generally improved by contacting the absorbent with added steam either simultaneously or subsequent to treatment with hydrogen and/or a hydrocarbon in the presence of a cracking catalyst. It is believed that at least some metal sulfide is usually formed according to equation (6) above and that added steam serves to promote the conversion of this metal sulfide to hydrogen sulfide with simultaneous reactivation of the absorbent.

With further reference to the use of a regenerable sulfur oxide absorbent to reduce emissions of sulfur oxides from the regeneration zone, although not necessary, it is desirable that the regeneration zone effluent gas contain at least a small amount of molecular oxygen. Desirably, this effluent gas contains at least about 0.01 volume percent, preferably at least about 0.5 volume percent, more preferably at least about 1.0 volume percent, and ideally about 2.0 volume percent of molecular oxygen. The ability of the absorbent to absorb sulfur oxides is generally improved as the amount of molecular oxygen in the effluent gas increases. Although the reason for this effect by molecular oxygen is uncertain, it is believed that increased concentrations of oxygen serve to promote the conversion of sulfur dioxide to sulfur trioxide. It is further believed that this sulfur trioxide is more easily absorbed by the absorbent than is sulfur dioxide. Similarly, it is believed that an absorbent is better able to absorb sulfur oxides in the presence of an oxidation promoter because the promoter serves to catalyze the conversion of sulfur dioxide to sulfur trioxide which is more easily absorbed by the absorbent.

The following examples are intended only to illustrate the invention and are not to be construed as imposing limitations on the invention.

EXAMPLE 1

A solution of 195.6 grams of ceric ammonium nitrate $[Ce(NH_4)_2(NO_3)_6]$ in 500 milliliters of water was slowly added to 8500 grams of alumina hydrosol (PHF alumina sol obtained from American Cyanamide Co., 10.3 weight % solids content) with mixing in a blender. Then, a dispersion of 110 grams of REY (prepared by exchanging Union Carbide SK-40, a powder form of Linde type NaY molecular sieve, with an aqueous solution containing about 60 weight % of rare earth chlorides which is sold by the Davison Chemical Division of W. R. Grace & Co. as product No. 1413) in 500 milliliters of water was slowly added with mixing in the blender, and mixing was continued until particles of REY were no longer visible. Finally, the mixture was gelled by the addition of 240 milliliters of concentrated ammonium hydroxide solution while mixing was continued in the blender. The resulting gel was dried overnight at 120° C., calcined at 540° C. for 3 hours, ground to pass through a 100 mesh sieve and collected on a 325 mesh sieve. The resulting particulate solid had a surface area of 353 $m^2/g$ and contained 13% REY in addition to cerium and gamma-alumina.

EXAMPLE 2

A 100 gram test sample consisting of a mixture of 99 grams of equilibrium HFZ-33 cracking catalyst analyzing for 51.5% $Al_2O_3$ (HFZ-33 is manufactured by Engelhard Minerals & Chemicals Corporation) and 1 gram of the particulate sulfur oxide absorbent prepared according to Example 1 was placed on top of a plug of quartz wool in a Vycor glass reactor having a diameter of 5 centimeters and a length of about 51 centimeters. The reactor was then placed in a tube furnace which provided the desired experimental temperatures, and a series of test gases were passed upwardly through the fixed fluidized bed of test sample in the reactor. Effluent gas from the reactor was analyzed for sulfur oxide and hydrogen sulfide content.

The test sample was heated to a temperature of 732° C. while a nitrogen purge gas was passed upwardly through it at a flow rate of 996 $cm^3$/min. After a 52 minute purge, a synthetic gas mixture composed of 0.15 volume % sulfur dioxide, 4 volume % oxygen, 2.5 volume % water vapor and the remainder being nitrogen, was passed through the test sample at a temperature of 732° C. and a flow rate of 993 $cm^3$/min. over a period of 25 minutes. At the end of this 25 minute period, the test sample had absorbed an amount of sulfur dioxide equivalent to 442.4 ppm by weight of sulfur.

After purging with nitrogen for 12 minutes at a temperature of 538° C. and a flow rate of 1025 $cm^3$/min., the test sample containing absorbed sulfur dioxide was fluidized with hydrogen for 1 minute at a temperature of 538° C. and a flow rate of 1020 $cm^3$/min. This was followed by a nitrogen purge for 5.5 minutes at 538° C. and a flow rate of 1023 $cm^3$/min. The contacting with hydrogen in combination with the subsequent nitrogen purge resulted in a release of 232.6 ppm or 53% of the absorbed sulfur from the test sample. Of this sulfur, 94.4 ppm was removed as sulfur dioxide and/or sulfur trioxide and 138.2 ppm was removed as hydrogen sulfide.

The test sample was next fluidized with a gas mixture consisting of 4.8% oxygen and 95.2% nitrogen at a temperature of 732° C. and a flow rate of 829 $cm^3$/min. over a period of 2 minutes. This was followed by a nitrogen purge for 5 minutes at 732° C. with a flow rate of 1020 $cm^3$/min. The contacting with oxygen in combination with the subsequent nitrogen purge resulted in the additional release of 194.1 ppm or 44% of the initially absorbed sulfur from the test sample as sulfur dioxide and/or sulfur trioxide. The sequence involving contacting with hydrogen followed by contacting with oxygen resulted in a total removal of 97% of the initially absorbed sulfur from the sample.

Finally, the test sample was again fluidized with the above described synthetic gas mixture containing 0.15 volume % of sulfur dioxide at a flow rate of 993 $cm^3$/min. and a temperature of 732° C. After 25 minutes, the test sample had absorbed an amount of sulfur dioxide equivalent to 387.3 ppm by weight of sulfur.

These results demonstrate that (1) the test sample can absorb sulfur dioxide at 732° C., (2) a substantial portion of the absorbed sulfur dioxide can be released as a sulfur-containing gas upon brief contact of the test sample with hydrogen at 538° C., (3) the portion of absorbed sulfur dioxide which is not removed by contact with hydrogen can be released as a sulfur-containing gas by a subsequent brief contact of the test sample with oxygen at 732° C., and (4) after removal of absorbed sulfur dioxide, the test sample can be reused to absorb additional sulfur dioxide.

EXAMPLE 3

The ability of a 100 gram sample of equilibrium HFZ-33 particulate cracking catalyst analyzing for 51.5% $Al_2O_3$ (HFZ-33 is manufactured by Engelhard Minerals & Chemicals Corporation) to absorb sulfur dioxide from a gas stream and to release the absorbed sulfur dioxide as a sulfur-containing gas through contact with a mixture of hydrogen and steam was evaluated using the apparatus described in Example 2. The sample was initially heated to a temperature of 732° C. while a nitrogen purge gas was passed upwardly through it at a flow rate of 1000 $cm^3$/min. After a 180 minute purge, a synthetic gas mixture containing 0.15 volume % sulfur dioxide and having the same composition as set forth in Example 2 was passed through the sample at a temperature of 732° C. and a flow rate of 1003 $cm^3$/min. over a period of 25 minutes. At the end of this 25 minute period, the test sample had absorbed an amount of sulfur dioxide equivalent to 294.7 ppm by weight of sulfur.

After purging with nitrogen for 12 minutes at a temperature of 538° C. and a flow rate of 1069 $cm^3$/min., the test sample containing absorbed sulfur dioxide was fluidized for 1 minute with a mixture of hydrogen and steam at a temperature of 538° C. and a flow rate of 1232 $cm^3$/min. of hydrogen and 0.4 g/min. of water. This was followed by a nitrogen purge for 24 minutes at a flow rate of 1057 $cm^3$/min. as the sample temperature was increased from 538° to 732° C. The contacting with hydrogen and steam in combination with the subsequent nitrogen purge resulted in a release of 337.0 ppm or 114% of the initially absorbed sulfur from the test sample. Of this sulfur, 85.8 ppm was removed as hydrogen sulfide and 251.2 ppm was removed as sulfur dioxide and/or sulfur trioxide.

The test sample was next fluidized with a gas mixture consisting of 4.8% oxygen and 95.2% nitrogen at a temperature of 732° C. and a flow rate of 940 $cm^3$/min. over a period of 2 minutes. This contacting of the sample with oxygen did not result in the release of any additional sulfur from the test sample.

Finally, the test sample was again fluidized with the synthetic gas mixture containing 0.15 volume % of sulfur dioxide at a flow rate of 1003 $cm^3$/min. and a temperature of 732° C. After 25 minutes, the test sample had absorbed an amount of sulfur dioxide equivalent to 271.9 ppm by weight of sulfur.

These results demonstrate that (1) the test sample can absorb sulfur dioxide at 732° C., (2) all of the absorbed sulfur dioxide can be released as a sulfur-containing gas upon brief contact of the test sample with a mixture of hydrogen and steam at 538° C., and (3) after removal of absorbed sulfur dioxide, the test sample can be reused to absorb additional sulfur dioxide.

I claim:

1. In a process for the cyclic, fluidized catalytic cracking of a sulfur-containing hydrocarbon feedstock which comprises (i) cracking said feedstock in a reaction zone through contact with solid particles to produce lower boiling hydrocarbons and cause a deposit of sulfur-containing coke on said particles, wherein said solid particles comprise cracking catalyst and a regenerable sulfur oxide absorbent; (ii) passing coke-containing solid particles from the reaction zone to a regeneration zone; (iii) removing said sulfur-containing coke deposit from the solid particles in said regeneration zone by burning with an oxygen-containing gas, thereby forming sulfur oxides; (iv) absorbing with said absorbent at least a portion of the sulfur oxides produced by said burning of the sulfur-containg coke deposit in said regeneration zone; and (v) passing coke-depleted solid particles from the regeneration zone to the reaction zone; a method for decreasing emissions of sulfur oxides from the regeneration zone which comprises:

(a) continuously withdrawing a stream of coke-depleted solid particles having sulfur oxides absorbed therein from the regeneration zone and passing said stream to a reducing zone;

(b) contacting said stream in the reducing zone with a reducing gas at a temperature in the range from about 590° to about 820° C., said reducing gas comprising at least one component selected from the group consisting of hydrogen and hydrocarbons, whereby absorbed sulfur oxides in said stream of particles are released as a sulfur-containing gas; and (c) after said contacting with the reducing gas in said reducing zone, passing the stream of particles back to the inventory of solid particles which is circulated between said reaction and regeneration zones.

2. The process as set forth in claim 1 wherein all of said solid particles employed in the reaction zone are withdrawn from the reducing zone.

3. The process as set forth in claim 1 wherein a stream of coke-depleted solid particles having sulfur oxides absorbed therein is passed directly from the regeneration zone to the reaction zone, and a side-stream of coke depleted solid particles having sulfur oxides absorbed therein is passed to said reducing zone.

4. The process as set forth in claim 3 wherein the reducing gas comprises hydrogen.

5. The process as set forth in claim 3 or 4 wherein said side-stream of particles is returned to the regeneration zone after contact with said reducing gas.

6. The process as set forth in claim 3 or 4 wherein said side-stream of particles is passed to the reaction zone after contact with the reducing gas.

7. The process as set forth in claim 3 or 4 wherein the reducing gas additionally comprises steam.

8. The process as set forth in claim 3 or 4 wherein the side-stream is additionally contacted with steam after withdrawal from the reducing zone and before return to the inventory of solid particles which is circulated between the reaction and regeneration zones.

9. The process as set forth in claim 3 or 4 wherein the side-stream is additionally contacted with oxygen after withdrawal from the reducing zone and before return to the inventory of solid particles which is circulated between the reaction and regeneration zones.

10. The process as set forth in claim 4 wherein the reducing gas comprises a mixture of hydrogen and low molecular weight hydrocarbons.

11. The process as set forth in claim 10 wherein said low molecular weight hydrocarbons contain from 1 to 4 carbon atoms.

12. The process as set forth in claim 4 wherein the amount of solid particles withdrawn as a side-stream from the regeneration zone is from about 0.01 to about 50 percent of the total amount of solid particles which is passed to the reaction zone.

* * * * *